US005603171A

United States Patent [19]

Steinkühler

[11] Patent Number: 5,603,171

[45] Date of Patent: Feb. 18, 1997

[54] PROCESS AND APPARATUS FOR SUCTIONING OFF THE SOLID MATERIAL FROM WATERBEDS

[75] Inventor: Siegfried Steinkühler, Schwartau, Germany

[73] Assignee: Krupp Fördertechnik GmbH, Duisburg, Germany

[21] Appl. No.: 389,876

[22] Filed: Feb. 17, 1995

[30] Foreign Application Priority Data

Feb. 21, 1994 [DE] Germany ..... 44 05 451.3

[51] Int. Cl.[6] ..... E02F 1/00

[52] U.S. Cl. ..... 37/195; 37/323; 37/321; 37/333

[58] Field of Search ..... 37/195, 317, 319, 37/320, 321, 323, 324, 325, 333

[56] References Cited

U.S. PATENT DOCUMENTS

| | | | |
|---|---|---|---|
| 2,125,740 | 8/1938 | Schacht . | |
| 3,673,716 | 7/1972 | Trondle | 37/61 |
| 3,820,258 | 6/1974 | Fahrner | 37/195 X |
| 3,964,184 | 6/1976 | Mathieu | 37/195 |
| 3,971,593 | 7/1976 | Porte et al. | 37/195 X |
| 3,975,842 | 8/1976 | Andreae | 37/195 X |
| 4,018,483 | 4/1977 | Smith | 37/195 X |
| 4,053,181 | 10/1977 | Saito | 37/195 X |
| 4,141,159 | 2/1979 | Morris et al. | 37/195 X |
| 4,242,815 | 1/1981 | Vermeulen | 37/195 X |
| 4,261,117 | 4/1981 | van der Peyl | 37/58 |
| 4,418,484 | 12/1983 | Wolters et al. | 37/195 X |
| 4,760,656 | 8/1988 | East . | |

FOREIGN PATENT DOCUMENTS

| | | | |
|---|---|---|---|
| 2448308 | 4/1975 | Germany . | |
| 1484812 | 3/1976 | Germany . | |
| 2457020 | 11/1979 | Germany . | |
| 318355 | 9/1929 | United Kingdom . | |
| 1056632 | 1/1967 | United Kingdom | 37/63 |

OTHER PUBLICATIONS

Smith et al, "Diver's Excavating Device", Navy Technical Disclosure Bulletin, vol. 4, No. 4, Apr. 1979, Navy Tech. Cat. No. 7741, Navy Case No. 62795, pp. 37–39.

*Primary Examiner*—Terry Lee Melius
*Assistant Examiner*—Victor Batson
*Attorney, Agent, or Firm*—Spencer & Frank

[57] ABSTRACT

A process for suctioning solid material from a waterbed and for conveying a resulting solids-water suspension into a hopper is provided. A flow of water is supplied to a towed suction basket. The basket has a suction region connected to a suction tube, at least one pressure nozzle and at least one motive nozzle. The flow of water supplied to the towed suction basket is divided into a motive water flow and a pressure water flow. The pressure water flow is directed through the at least one water pressure nozzle onto the waterbed for dislodging the solid material on the waterbed and creating the solids-water suspension in the suction region of the towed suction basket. The motive water flow is directed through the at least one motive water nozzle through the suction region of the towed suction basket and into the suction tube for accelerating the solids-water suspension into the suction tube.

25 Claims, 4 Drawing Sheets

PROCESS AND APPARATUS FOR SUCTIONING OFF THE SOLID MATERIAL FROM WATERBEDS

CROSS-REFERENCE TO RELATED APPLICATION

This application claims the priority of Application No. P 44 05 451.3 filed Feb. 21, 1994 in Germany, the subject matter of which is incorporated herein by reference.

FIELD OF THE INVENTION

The invention relates to a process of suctioning solid material from a floor of a body of water, or waterbed, and of conveying a solids-water suspension obtained as a result of the suctioning into a hopper. The process comprises the steps of supplying a flow of water to at least one towed suction basket having a suction region, and directing water from the at least one towed suction basket onto the waterbed such that the solid material on the waterbed is loosened and dislodged.

The invention further relates to an apparatus for carrying out the above process in which a hopper is connected to at least one towed suction basket, a pressure line feeds pressurized water to the towed suction basket, a suction line is in flow communication with the pressure line, and at least one water pressure nozzle is disposed at a front region of the at least one towed suction basket and is connected to the pressure line.

BACKGROUND OF THE INVENTION

The towed suction basket described in German Patent Publication DE 14 84 812 C3 has several water pressure nozzles disposed at a close distance from each other above a waterbed for directing water under pressure onto the solid material thereon, and a rear suction gap formed by the rear edge of a backwardly extending hood, which is freely pivotal around a horizontal axis transverse to the tow direction of a towed suction basket. The width of the suction gap is determined by sliding blocks on the rear edge of the hood. Because of the above construction, the towed suction basket can rest in a sealing manner on the waterbed on its front edge while a pressure jet of water is directed down to a desired depth into the solid material on the waterbed by means of the row of the pressure nozzles. As a result of the above, the solid material on the waterbed is loosened, dislodged, and dispersed in the area of the suction gap.

The above-described towed suction basket and of the method associated with its use has the disadvantage of creating an unfavorable ratio of the amount of suctioned solid material to the conveyed amount of water, which ratio is approximately 1:3. A considerable amount of water pressure at a pressure of approximately 6 bar must be maintained in order to loosen satisfactory amounts of the solid material on the waterbed.

German Patent Publication DE 24 48 308 C2 discloses the use of a suction pump located in the suction line, as well as a pressure pump located in the pressure water line to the towed suction basket, for suctioning the interior of the hopper, so that the water suctioned with the solid material can be returned to the vicinity of an outlet for the suction line to serve as feed medium for the solids to be suctioned. The aspiration of the overflow water is performed via a suction basket, whose height in the hopper or the box frame is set to correspond to the desired filling level at that location.

Prior art constructions concerning the loading and unloading of the hopper in a hopper suction dredger lead to other disadvantages, as will be described below.

First, during loading of the hopper, it is necessary to ensure that water is removed to the greatest extent possible from the suctioned solids-water suspension, a large portion of which consists of water, in order to allow for optimum use of the loading capacity of the hopper. For this purpose, the mixture conveyed by the dredger pumps is introduced at one end of the hopper via U-pipes or open channels, after which the mixture flows through the length of the hopper. During this process, the dredged solid material can settle and the feed water can be diverted into the ocean via height-adjustable overflow dams to the extent that it has not been suctioned off, as described above. The above notwithstanding, any solid material with finer grains will still remain in the feed water flowing or being pumped out, creating so-called overflow losses, which are essentially a function of the flow-through speed in the hopper.

To minimize overflow losses, it has already been proposed to introduce the solids-water suspension into the hopper through a box frame disposed in the center of the dredging vessel or dredger, with overflow mechanisms located at both longitudinal ends of the hopper. As a result of the above construction, the mean flow-through speed through the hopper is theoretically cut by half, so that the deposition conditions for the solids carried along are improved and the loading time can be correspondingly shortened. Overflow losses can be reduced by approximately one third according to the above construction.

To empty the hopper of solids filled therein, it is necessary to first render the solids flowable once more. The above is accomplished by supplying water to the surface of the solids, or by the introduction of water via nozzles in the bottom of the hopper, or by like methods. To accomplish the above, German Patent Publication DE 24 57 020 C3 proposes moving the flowable solids-water suspension off the hopper via a height-adjustable overflow device disposed in a separate chamber, or to let the solids-water mixture flow out of the bottom of the hopper, which is inclined in the longitudinal direction of the vessel, and which is provided, on it lowest point, with a closeable bottom opening. As a controllable flow-off dam, the overflow device can consist of a plurality of flaps, or annular dams, or dam rings disposed on top of one another.

OBJECT AND SUMMARY OF THE INVENTION

It is the object of the invention to improve the ratio of the amount of dredged solids to the water pumped along with the solids during the suctioning process without giving up the advantages of the processes and installations of the prior art.

This object and others to become apparent as the specification progresses, are accomplished by the invention, according to which, briefly stated, the flow of water supplied to the towed suction basket is divided into a motive water flow and a pressure water flow; the pressure water flow is directed through at least one water pressure nozzle onto the waterbed for dislodging solid material on the waterbed and creating the solids-water suspension in the suction region of the towed suction basket; and the motive water flow is directed through at least one motive water nozzle through the suction region of the towed suction basket and into the suction tube for accelerating the solids-water suspension into the suction tube.

The invention is based on a recognition that two tasks must be performed in the course of dredging solid material from the waterbed, namely, bringing the solid material into suspension, and accelerating the solid material toward the suction tube. In order to preserve the advantageous disposition of the row of nozzles at the front region of the towed suction basket, which disposition allows the generation of a solid water suspension directed toward the rear of the suction basket with respect to the tow direction, water introduced by the partial redirection of the water into the area of the rear region via nozzles is utilized as motive water flow. By means of the above construction, it is possible to inject a greater amount of water for loosening the solid material from the waterbed. The mixture is actively accelerated by the motive water flow. The solids proportion in the conveyed mixture can be considerably increased by this step.

The pressure water flow is directed vertically toward the waterbed, leading to an optimal loosening or optimal dislodging of the solid material on the waterbed in the suction region. The motive water flow for the active acceleration of the loosened bottom material is preferably introduced into the suction region in the rear region of the towed suction basket in the direction toward the suction tube. The above step ensures that the respective nozzle flows do not act counter to one other and are not partially compensated.

The ratio of pressure water flow to motive water flow is regulated or controlled as a function of the character of the solid material on the waterbed. Depending on the material on the waterbed, the pressure water flow required for loosening the material can be reduced in favor of the motive water flow, and vice versa. A ratio of pressure water flow to motive water flow of 40:60 has been found to be advantageous.

In accordance with a further aspect of the invention, the suction region located above the waterbed and into which the two partial flows are directed is essentially screened from the surrounding water by a hood of the towed suction basket, such that the motive water flow and the pressure water flow together constitute the feed water being suctioned off by the suction tube. The screening hood further ensures that stresses on the environment during suctioning are avoided.

To minimize stresses on the environment, in accordance with a further aspect of the invention, the water supplied to the towed suction basket is at least partially, preferably entirely, taken from the overflow water in the hopper. The water is preferably removed or suctioned from the hopper via a central suctioning shaft. In accordance with a still further aspect of the invention, the suctioning shaft is used for emptying the hopper when the solids conveyed thereto, which solids have been made flowable, are removed, preferably after lowering the overflow dams. The suctioning shaft can further be used for removing overflow water during loading of the hopper.

The process parameters, such as pressure of the pressure water, suction output, etc., are preferably set in such a way that the amount of feed water in the suction tube is approximately equal to the amount of solids therein.

The object of the invention is furthermore attained by an apparatus comprising a hopper; a towed suction basket including a suction region, a front edge and a rear edge relative to the tow direction; at least one water pressure nozzle disposed in an area of the front edge and at least one motive water nozzle disposed in an area of the rear edge; a suction tube coupled between the suction region of the towed suction basket and the hopper for conveying solids-water suspension from the suction region to the hopper; and a pressure line for supplying water under pressure, the pressure line terminating in a first partial line connected to the at least one water pressure nozzle and a second partial line connected to the at least one motive water nozzle.

According to a further feature of the invention, the cross sections of the water pressure nozzle and the motive water nozzle are adjustable preferably with the use of appropriate hydraulic controls, for adjusting flow through the nozzles. The above feature allows adapting conveyed volume of water to the requirements of the system via regulating or control valves, without creating the need for restructuring or replacing of the suction tube.

The pressure water nozzles at the front region and/or the motive water nozzles at the rear region are preferably disposed next to one another in a row. The pressure water nozzles and the motive water nozzles can further be disposed in rows parallel to one another, so that an even distribution of the pressure water flow for loosening the solid material on the waterbed, as well as of the motive water flow, results. The outlet openings of the motive water nozzles are directed in the direction of the suction tube in order to cause an optimum acceleration of the suspended solids portion from the waterbed.

The towed suction basket is covered by a hood which is pivotal around an axis transverse to the tow direction, and which is disposed such that lateral and rear bottom edges of the hood are seated on the waterbed without forming gaps leading from surrounding water into the suction region. With the preferable all-around sealing of the suction region with respect to the surrounding body of water, it is possible to considerably increase the ratio of the portion of solids to the portion of water in the suction tube so as to preferably obtain approximately equal portions of each.

In order to take into account any unevenness on the waterbed, the hood is composed of several parts and has partial walls capable of being pivoted or raised and lowered relative to one another for adaptation to the waterbed.

The pressure line is connected with the suctioning shaft of the hopper so that it is possible to use the overflow water conveyed during the dredging cycle. The suctioning shaft is preferably a central shaft located approximately in the center region of the hopper. In accordance with a further aspect of the invention, the suctioning line is disposed so that it feeds solids-water suspensions into the hopper via two box frames disposed at longitudinal ends of the hopper.

In accordance with a further embodiment of the invention, the central suctioning shaft has two height-adjustable overflow devices, which are preferably embodied as annular dams.

By means of this construction it is possible to utilize the central suctioning shaft for returning the overflow water during loading as well as during unloading of the hopper following fluidization of the solids.

In order to be able to replace lost pressure water and/or to make the solids in the hopper flowable, at least one auxiliary water connection is provided, through which water can be aspirated as a function of the water shortage present in the cycle.

DETAILED DESCRIPTION OF THE PREFERRED EMBODIMENT

Figure 1:
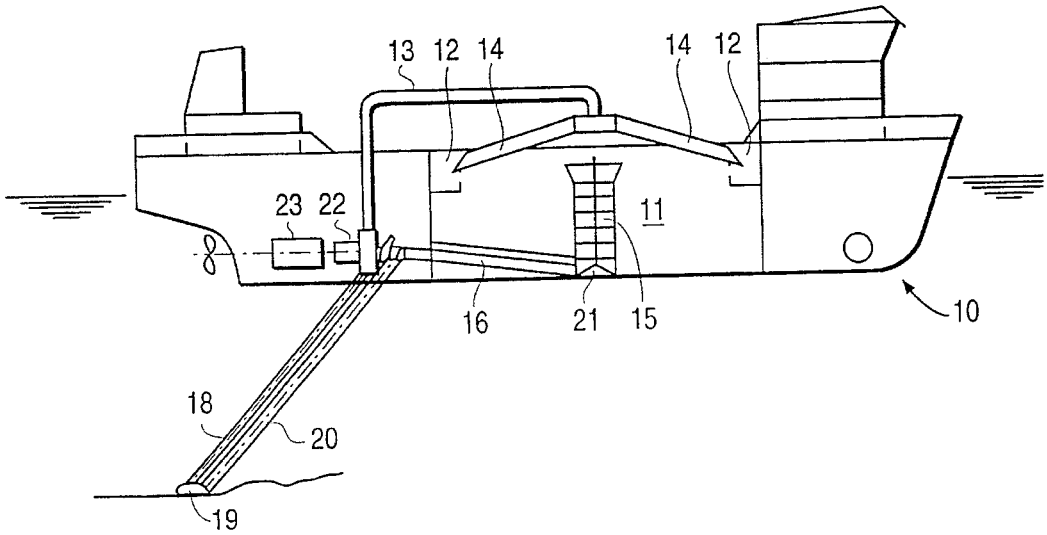
FIG. 1 is a longitudinal cross-sectional view of a hopper suction dredger according to the invention.
Figure 2:
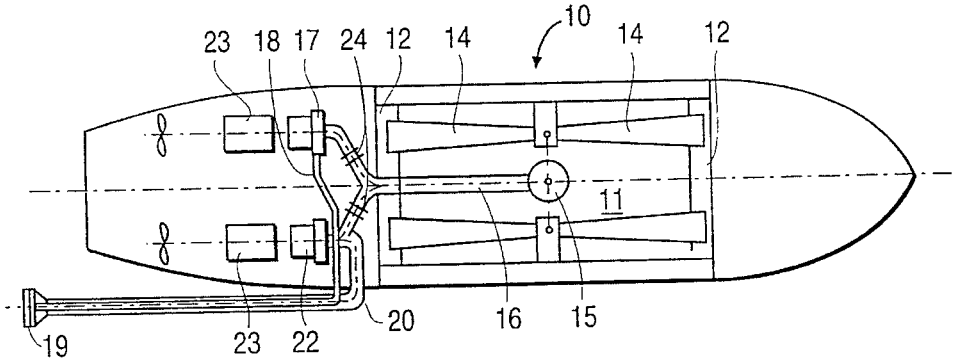
FIG. 2 is a top view of the hopper suction dredger according to FIG. 1.

A hopper suction dredging vessel 10 represented in FIGS. 1 and 2 has a hopper 11 located approximately in the center of the vessel which can be filled via box frames 12 disposed at respective longitudinal ends of the hopper. A solids-water mixture, or suspension, is conveyed via a feed line 13 and transported via channels 14 into box frames 12 before flowing into hopper 11. The water portion of the solids-water mixture flows toward a central suctioning shaft 15. The collection of overflow water by suctioning shaft 15 is conducted by a water pressure pump 17 via a line 16 into a pressure line 18 leading to towed suction basket or head 19. A suction tube 20 leads from towed suction basket 19 to a suction pump 22. The solids-water mixture reaches channels 14 via feed line 13.

Central suctioning and overflow shaft 15 has a bottom valve 21 which is connected with pump 17 and suction pump 22 via line 16. A once again fluidized solids mixture can be conducted via a controllable flow-off dam, as explained further below, into the central suctioning shaft 15 and for removal from the hopper. The bottom of hopper 11 is configured to include sections which are inclined in the direction of central suctioning shaft 15. A more detailed description of the operation of suctioning shaft 15 in connection with a fluidizing installation is disclosed in German Patent Publication 24 57 020 C3. Note that valve 21 may also be used to aspirate water required for pressure line 18 from the surrounding water.

Figure 3:
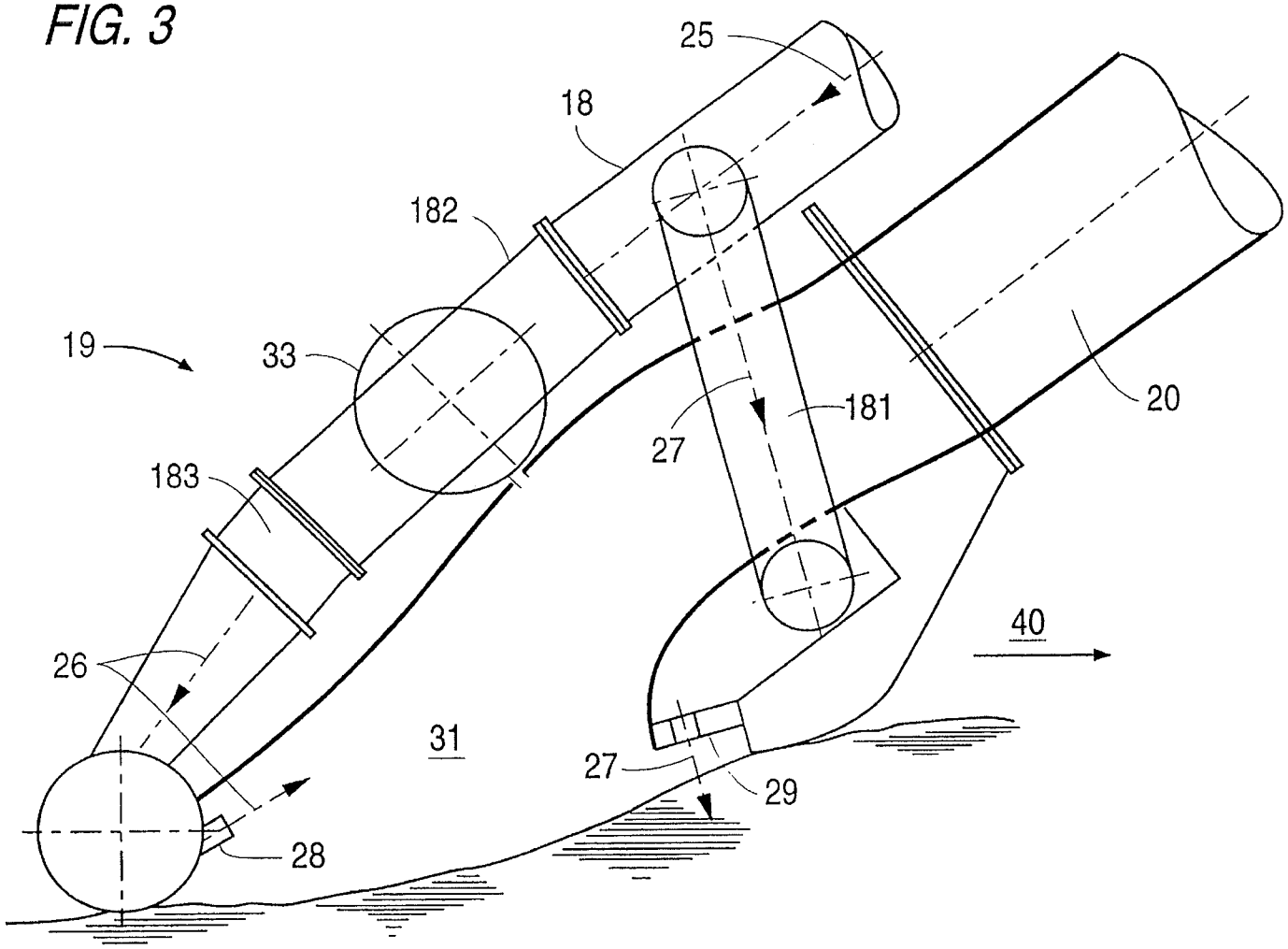
FIG. 3 is a cross sectional view of a towed suction basket according to the invention.

FIG. 3 shows an enlarged representation of the towed suction basket 19. Towed suction basket 19 includes pressure line 18, which is divided into a first line 181 and a second line 182, the latter being provided with a flow governor 183. The arriving water 25 is divided into a motive water flow 26 and a pressure water flow 27. Motive water flow 26 exits in the direction of suction tube 20 via one or a plurality of motive water nozzles 28 which are disposed next to one another in a row (see FIG. 4). Pressure water flow 27 is supplied to a plurality of water pressure nozzles 29 also disposed next to one another in a row. Water pressure nozzles 29 are disposed at the front region of a suction region 31 of towed suction basket 19, and motive water nozzles 28 are disposed on the rear region of basket 19, the front and rear regions of basket 19 being defined with respect to a direction of towing shown by arrow 40 in FIG. 3.

Figure 4:
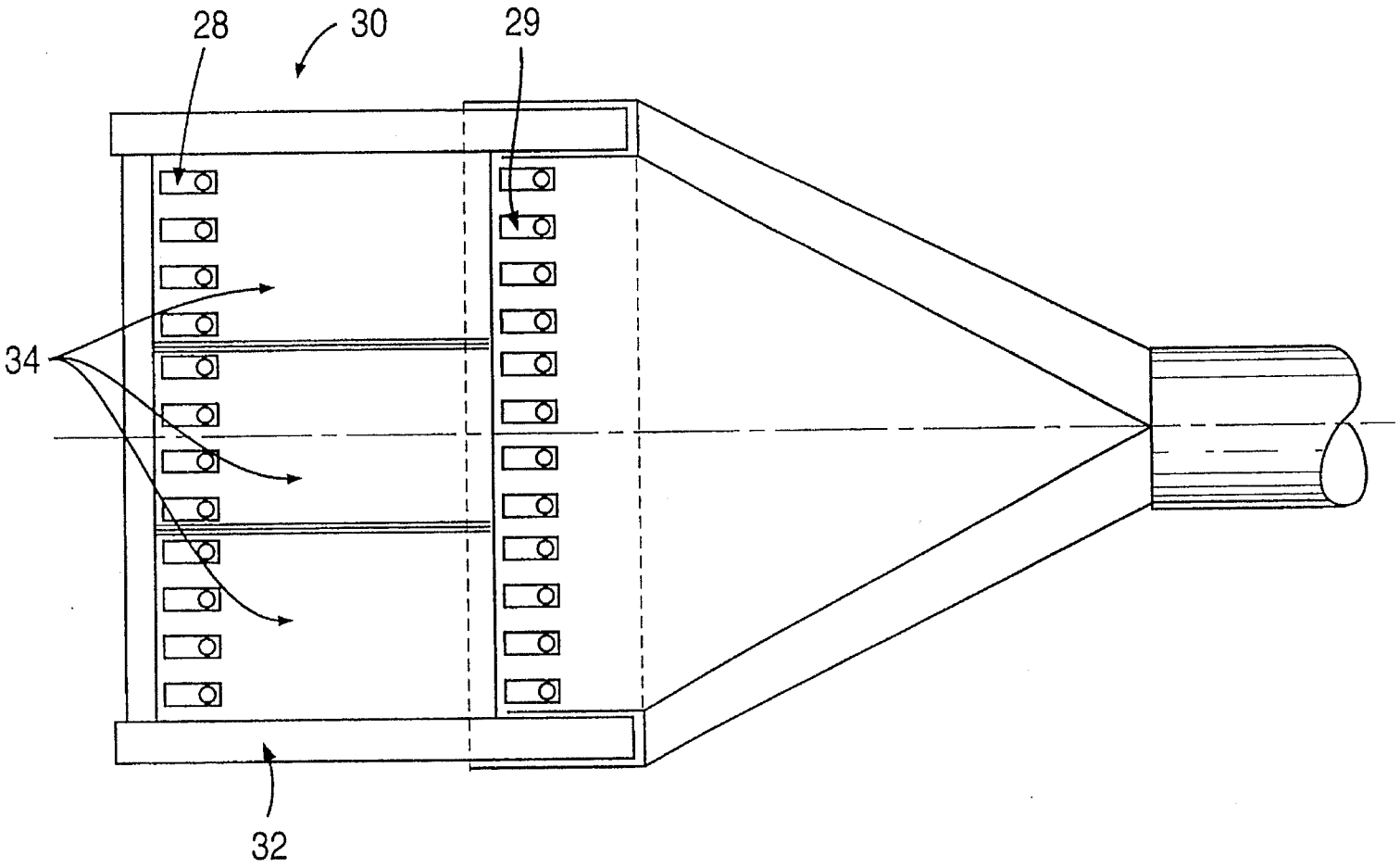
FIG. 4 is a bottom view of the towed suction basket according to FIG. 3.

As shown in FIG. 4, towed suction basket 19 is covered on all sides by a hood 30, so that suction region 31 is screened from the surrounding water. In order to establish efficient screening of the suction region in circumstances where the waterbed is uneven, hood 30 is preferably configured to comprise several parts and/or wall sections which can be pivoted or raised and lowered with respect to one another. This feature of the invention is suggested in FIG. 3 by a hinge symbolized by circle 33. As best seen in FIG. 4, hood 30 of suction basket 19 may consist of several roof parts 34 and lateral disks or walls 32 which can be raised and lowered with respect to one another. Motive water nozzles 28 are disposed in the rear region of hood 30 and water pressure nozzles 29 in its front region.

The configuration of the suctioning shaft 15 is explained in greater detail below with reference to FIG. 5, which shows the suctioning shaft with an overflow edge disposed at a lowered height. On the floor 10' of the hopper suction dredger 10, a guide pillar 41 is supported via radially disposed feet 42. The upper end of the guide pillar 41 is held at a bridge-like platform 43, which, in turn, is fastened to the side walls 10" of the hopper suction dredger 10.

Concentrically to guide pillar 41, a chamber 44 is disposed between bottom 10" of the hopper suction dredger and bottom 11' of the hopper 11, the chamber being formed by a cylindrical wall 45. The line 16 to the suction pump 22 branches off from chamber 44.

Figure 5:
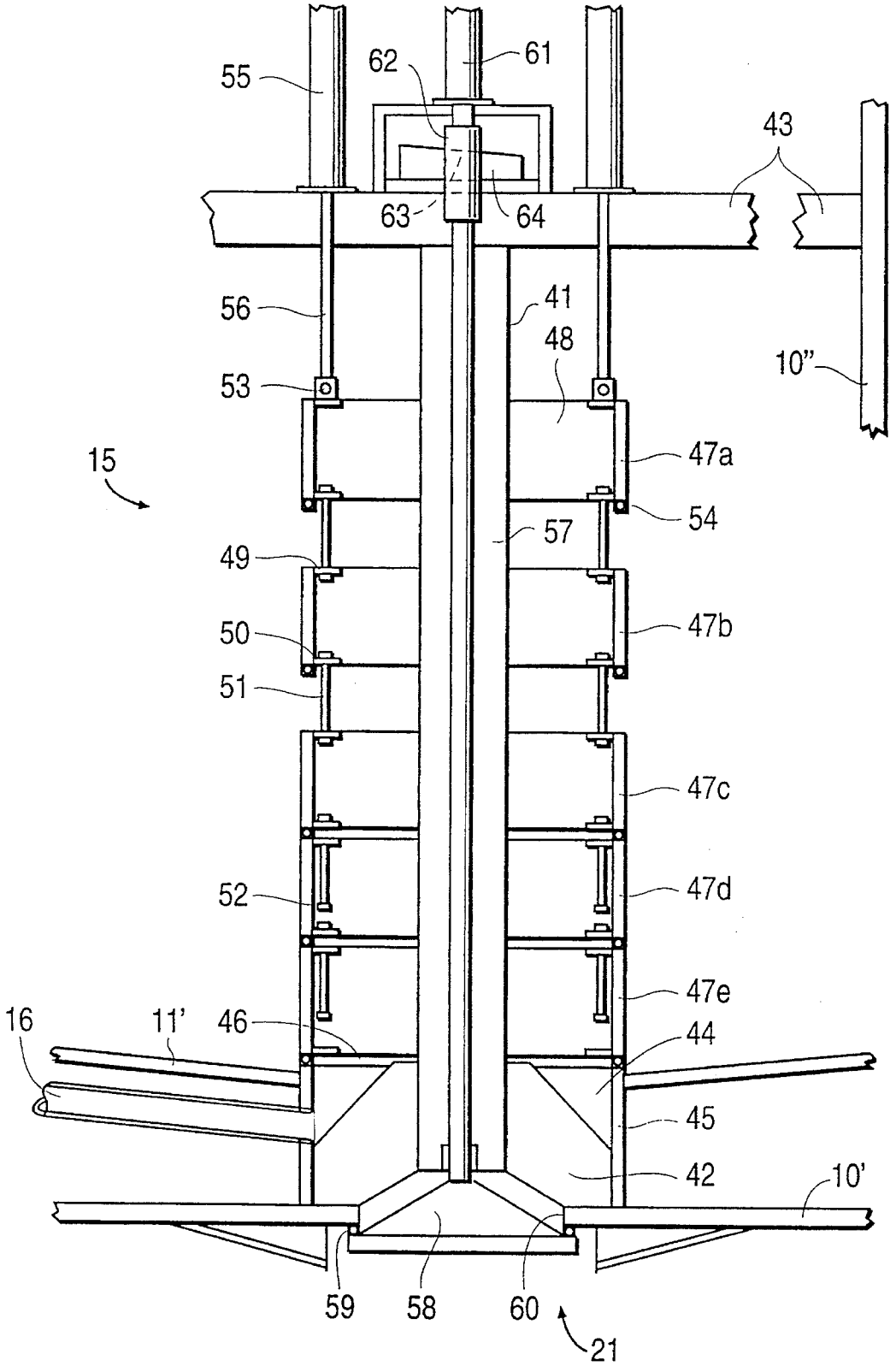
FIG. 5 is a longitudinal cross-sectional view through the suctioning shaft.

A plurality of dam rings **47*a* to 47*e* that are arranged on top of one another (five of such rings are illustrated in FIG. 5) are disposed above the upper face 46 of the cylindrical wall 45. Each dam ring is provided with radially disposed metal sheets 48 for the correct positioning of the dam rings, and further with a lower and upper flange 49 or 50. At the lower flange 50, tie rods 51 are anchored. Tie rods 51 extend through the upper flange 49 of the respectively lower dam ring and are provided with a head 52 at the bottom thereof. The upper flange 49 of the uppermost dam ring 47*a* is provided with joint eyes 53. The lower edge of each dam ring is provided with an elastic sealing ring 54. Cylinders 55 are supported on the bridge 43, the piston rods 56 of the cylinders being connected to the joint eyes 53**.

The valve rod 57 of a valve disk 58 is guided on the inside of guide pillar 41. In its upper position, valve disk 58 rests against a sealing ring 59, which is disposed around an opening 60 in the bottom 10' of the hopper suction dredger 10. Together with the opening 60 and the sealing ring 59, the valve disk 58 forms the bottom valve 21 which has already been mentioned. To close the bottom valve 21, the valve can be pulled upward by means of a hydraulic cylinder 61 supported on the bridge 43. In order to ensure that the hydraulic cylinder 61 can be relaxed, even when the bottom valve 21 is kept closed, the valve rod 57 is provided with a wedge lock 62 having an inner wedge surface 63. If the valve disk 58 is pulled up, i.e., if the bottom valve 21 is closed, a wedge 64, which is supported with its lower surface on the bridge 43, is inserted into the wedge lock 62.

The operation of the apparatus in accordance with the invention is as follows:

During dredging, or suctioning of the solid material from the waterbed, hopper suction dredger 10 tows one or a plurality of towed suction baskets 19 over the waterbed. The dredger may have a speed of approximately 1 m/s. Pressure water flow 27 supplied by pressure line 18 serves to loosen and dislodge the solid material on the waterbed, which solid material is subsequently fed, together with the total flow resulting from motive water flow 26 and pressure water flow 27, into hopper 11 by the action of pumps 17 and 22.

During the dredging process described above, hopper 11 is loaded with the solids-water suspension. While the solids in the solid material in the suspension drops to the bottom or floor 11' of hopper 11 (see FIG. 5), water from the surface of the suspension flows over the upper rim of central suction shaft 15 into the interior of hollow suction shaft 15. Central suctioning shaft 15 serves as an overflow shaft during loading of the hopper. The overflow water is suctioned off from central suctioning shaft 15 by water pressure pump 17, and thereafter recycled through pressure line 18 to towed suction basket 19.

Since the pressure of pressure water flow 27 is equal to the pressure of motive water flow 26, and is set at a value of between 3 and 5 bar, pump 17 can have a size that is appropriate for the dredger in which it is to be accommodated. Moreover, because the acceleration of the solids-water mixture according to the invention is no longer provided by the suction pump, and-since surrounding water from the region exterior of the basket is no longer aspirated by towed suction basket 19, the total pump output for the system according to the present invention is less by approximately 20% with respect to total pump outputs characteristic of systems used in the prior art. By introducing the entire amount of conveyed water as pressure or motive water into towed suction basket 19, the solids portion in the solids-water mixture can be increased to 50%. Thus, either the dredging time , i.e. the time for getting the hopper filled with dredged material, can be halved because of the relative increase of the conveyed amount of solids or, while maintaining the original dredging time, one suction tube including the associated dredging devices can be saved, that is, it would no longer be necessary to use one of the suction tubes and the associated dredging devices. Moreover, the above increase in the amounts of solids present in the dredged solids-water mixture results in a reduction of the flow-through speed in the hopper 11, along with a reduction in the overflow losses connected therewith. When omitting the use of a suction tube as described above, the freed dredging pump used in the prior art can be utilized as a return pump for the feed water to towed suction basket 19 in the closed cycle and as a pressure-increasing pump for rinsing.

If necessary, it is possible to admix water from the exterior of the cycle to the dredged solids-water mixture via bottom valve 21 of suctioning shaft 15, or to operate exclusively with water from the surrounding water. This can possibly take place automatically, for example in the case in which the vacuum upstream of the suction pump or the mixture concentration exceed predetermined threshold values.

During unloading of the hopper 11, which is principally performed in the manner described in German Patent Publication 24 57 020 C3, it is additionally possible to make use of the advantage of unloading of the fluidized solids via suctioning shaft 15.

Because of the central location of suctioning shaft 15, the longest path of travel to be traversed by a solids particle through the hopper 11 during emptying of the hopper only amounts to half of the diagonal of the hopper.

A disposition of all of the dam rings 47*a*–47*e* on top of one another determines the overflow height of the suctioning shaft 15, which is measured from the upper face 46 of the cylindrical wall 45 based on the number and height of the dam rings. During emptying of the hopper 11, an increasingly lower overflow height is required as the degree of filling decreases. For this purpose, the cylinders 55 are activated and their piston rods 56 are pulled in. At first, only the uppermost dam ring 47*a* is lifted, and the overflow height is determined by the upper edge of the dam ring 47*b*. If the piston rods 56 are pulled in further, the dam ring 47*b* is also lifted and the new overflow height is determined by the upper edge of the dam ring 47*c*—as is illustrated in FIG. 5. Thus, the overflow height can be lowered further down to the upper face 46 of the cylindrical wall 45.

The foregoing is a complete description of the present invention. Various changes may be made without departing from the spirit and scope of the present invention. The invention, therefore, should be limited only by the scope of the following claims.

What is claimed is:

1. A process for suctioning solid material from a waterbed and for conveying a resulting solids-water suspension into a hopper, comprising:

supplying a flow of water to a towed suction basket, the basket having a suction region connected to a suction tube, at least one pressure nozzle and at least one motive nozzle;

dividing the flow of water supplied to the towed suction a basket into a motive water flow and a pressure water flow;

directing the pressure water flow through the at least one water pressure nozzle onto the waterbed for dislodging the solid material on the waterbed and creating the solids-water suspension in the suction region of the towed suction basket; and directing the motive water flow through the at least one motive water nozzle through the suction region of the towed suction basket and into the suction tube for accelerating the solids-water suspension into the suction tube.

2. The process according to claim 1, wherein the step of conveying the solids-water suspension into the hopper comprises the step of conveying the solids-water suspension into the hopper via a box frame.

3. The process according to claim 1, wherein the hopper is located in a hopper suction dredging vessel.

4. The process according to claim 1, wherein the step of directing the pressure water flow comprises the step of directing the pressure water flow vertically toward the waterbed at a front region of the towed suction basket relative to a tow direction of the towed suction basket.

5. The process according to claim 1, wherein the step of directing the motive water flow comprises the step of introducing the motive water flow into the suction region of the towed suction basket from a rear region thereof toward the suction tube.

6. The process according to claim 1 and further including the step of regulating the ratio of the pressure water flow to the motive water flow as a function of the solid material on the waterbed.

7. The process according to claim 1, including controlling the ratio of the pressure water flow to the motive water flow to be about 40 to 60.

8. The process according to claim 1 and further including the step of screening the suction region of the towed suction basket from surrounding water by a hood such that the pressure water flow and the motive water flow together constitute a feed water flow in the suction tube of the towed suction basket.

9. The process according to claim 1, wherein the step of supplying a flow of water comprises the step of supplying the flow of water to the towed suction basket at a pressure of about 3 to 5 bar.

10. The process according to claim 1, wherein the step of supplying a flow of water comprises the step of taking overflow water from the hopper and supplying the overflow water to the towed suction basket such that the flow of water supplied to the towed suction basket is at least partially constituted by the overflow water taken from the hopper.

11. The process according to claim 10, wherein the step of taking overflow water comprises the step of suctioning overflow water from the hopper via a central suctioning shaft.

12. The process according to claim 11, and further including the steps of using the suctioning shaft for emptying fluidized solids from the hopper and for removing overflow water from the hopper during loading of the hopper.

13. The process according to claim 1, including suctioning through the suction tube a solids-water suspension that has an approximately equal amounts of solids and water.

14. An apparatus for carrying out the process according to claim 1, comprising:

a hopper;

a towed suction basket including a suction region, a front edge and a rear edge relative to the tow direction, at least one water pressure nozzle disposed in an area of the front edge and at least one motive water nozzle disposed in an area of the rear edge;

a suction tube coupled between the suction region of said towed suction basket and said hopper for conveying a solids-water suspension from the suction region to the hopper; said at least one motive water nozzle having an outlet opening directed toward the suction tube; and a pressure line for supplying water under pressure, said pressure line being divided into a first partial line connected to said at least one water pressure nozzle for providing pressure water flow to said at least one water pressure nozzle, and a second partial line connected to said at least one motive water nozzle for providing motive water flow to said at least one motive water nozzle for accelerating the solids-water suspension into the suction tube.

15. The apparatus according to claim 14 and further including means for adjusting cross sections of the at least one water pressure nozzle and the a least one motive water nozzle thereby adjusting water flow through the nozzles.

16. The apparatus according to claim 15, wherein the means for adjusting is hydraulic.

17. The apparatus according to claim 14, wherein the at least one pressure water nozzle has an outlet opening directed toward the waterbed.

18. The apparatus according to claim 14, wherein said at least one water pressure nozzle comprises a plurality of water pressure nozzles and said at least one motive water nozzle comprises a plurality of motive water nozzles, and at least one of the plurality of water pressure nozzles and the plurality of motive water nozzles are disposed adjacent to each other in a row.

19. The apparatus according to claim 14, and further including a hood for covering the towed suction basket such that lateral and rear bottom edges of the hood are seated on the waterbed without forming gaps leading from surrounding water into the suction region, the hood being pivotal about an axis which is transverse to the tow direction of the towed suction basket.

20. The apparatus according to claim 19, wherein the hood includes several parts that can be pivoted, raised and lowered with respect to one another for adapting the hood to unevennesses on the waterbed.

21. The apparatus according to claim 14, wherein the hopper further includes a suctioning shaft connected to the pressure line.

22. The apparatus according to claim 21, wherein the suctioning shaft is a central suctioning shaft disposed approximately in a center region of the hopper.

23. The apparatus according to claim 14 and further including two box frames disposed over longitudinal ends of the hopper, the suctioning line feeding the solid-water suspension into the two box frames.

24. The apparatus according to claim 21, wherein the suctioning shaft includes height-adjustable overflow devices.

25. The apparatus according to claim 24, wherein the overflow devices are annular dams.

* * * * *